United States Patent [19]

Zlobinsky et al.

[11] Patent Number: 5,036,679

[45] Date of Patent: Aug. 6, 1991

[54] OIL SEPARATION FROM REFRIGERANT GAS FLOW

[75] Inventors: Yury Zlobinsky, Massapequa, N.Y.; Phillip E. Bracht, San Mateo, Calif.

[73] Assignee: Savant Instruments, Inc., Farmingdale, N.Y.

[21] Appl. No.: 544,748

[22] Filed: Jun. 27, 1990

[51] Int. Cl.[5] ..... F25B 43/02

[52] U.S. Cl. ..... 62/470; 62/512; 55/257.5

[58] Field of Search ..... 62/468, 470, 473, 512, 62/292; 55/257.5, 462

[56] References Cited

U.S. PATENT DOCUMENTS

| | | | |
|---|---|---|---|
| 3,867,115 | 2/1975 | Heintzelman | 55/462 |
| 4,282,717 | 8/1981 | Bonar | 62/84 |
| 4,318,279 | 3/1982 | Gram | 62/470 |
| 4,478,050 | 10/1984 | Di Carlo et al. | 62/193 |
| 4,967,570 | 11/1990 | Van Steenburgh, Jr. | 62/292 |

FOREIGN PATENT DOCUMENTS

| | | |
|---|---|---|
| 914341 | 1/1963 | United Kingdom . |
| 1512507 | 1/1978 | United Kingdom . |

*Primary Examiner*—Henry A. Bennet
*Assistant Examiner*—John Sollecito
*Attorney, Agent, or Firm*—Morrison Law Firm

[57] ABSTRACT

A pressurized flow of a refrigerant gas discharged from a gas compressor and which has compressor lubricating oil entrained as a mist therein, is subjected to an oil separation in a separating unit of a separator assembly wherein by impacting flow of the oil-containing gas against impact structure in the separating unit, oil is caused to separate from the gas with the oil falling to the bottom of the separating unit, post-impact flow of the refrigerant gas being in a torturous flow path in the separating unit which torturous flow produces further and additional oil separation from the gas. The gas ultimately, has outlet from the unit at an upper end thereof from whence the gas passes to a point of use, the separated oil passing from the unit through a return capillary tube conduit to the compressor.

13 Claims, 2 Drawing Sheets

OIL SEPARATION FROM REFRIGERANT GAS FLOW

BACKGROUND OF THE INVENTION

The present invention relates to separation of oil from a refrigerant gas flow and refers more particularly to separation from a refrigerant pressurized gas flow gas of oil entrained therein as a mist. This oil is present in the refrigerant as an incident of compression of the gas in a lubricated compressor and commonly is separated from the refrigerant gas flow as that flow discharges from the compressor with the separated oil being returned to the compressor.

Separation is effected for various reasons including need to prevent an oil mass buildup at a flow circuit location where refrigerant passage could be obstructed or blocked. Such a condition could result in system non-function, i.e., cooling, at the least, and no refrigerant return to a compressor with resultant compressor burnout at worst. Also oil carry through into certain refrigeration system locations can act as an insulator and cut down intended heat transfer from a space or substance to be cooled.

The desirability and/or need for separating oil from a refrigerant gas flow is known and to such end, various and highly effective oil separators, e.g., cartridge type units are known and used. But these known separators generally are used only in medium-to-large refrigeration systems as their cost and size deters use in small systems. Also, known types of separators if used in a small system, might capture all the lubricating oil and hold it if the oil return line connecting the separator and compressor becomes blocked, or the device by which oil discharge from the separator is effected malfunctions. In this last-mentioned case, the compressor being starved of lubricant burns out.

OBJECTS AND SUMMARY OF THE INVENTION

Accordingly, it is an object of the invention to provide an oil separator assembly for separating oil from refrigerant gas and a method for effecting such separation which overcomes the drawbacks of the prior art.

It is a further object of the invention to provide an oil separator assembly for separating oil from a refrigerant gas which is suited for use in a wide range of refrigeration cooling systems inclusive of air conditioning systems, refrigerators, plural-stage or cascade type refrigeration systems wherein cooling temperatures of as low as minus 150 degrees C. (or lower) are attained and at which temperatures any compressor lubricating oil present in the refrigerant would freeze and lead to blockage of the refrigerating gas flow circuit.

It is a still further object of the invention to provide an oil separator and oil separation method for a refrigerant gas flow circuit which returns separated oil to the gas compressor by means of a capillary tube, and in a manner that is self-balancing and passively functioning.

Another object of the invention is to provide an oil separator which is readily and inexpensively manufactured and therefore, particularly suited for use in small refrigeration systems but yet being equally and effectively used in upscaled forms thereof on larger refrigeration systems.

Briefly stated, there is provided an assembly and method wherein a pressurized flow of a refrigerant gas which has compressor lubricating oil entrained as a mist therein, is subjected to an oil separation in a separating unit wherein by impacting flow of the oil-containing gas against an impact structure in the separator, a first separation of oil from the gas takes place, with the thus separated oil falling to the bottom of the separator. Post-impact flow of the refrigerant gas then follows a torturous flow path in the separator during which two further oil separations can occur with the gas flow having outlet from the top of the separator whence the gas passes to the flow circuit in usual fashion to a point of refrigerant cooling use. The separated oil passes from the separator through a return capillary tube conduit to the compressor.

In accordance with these and other objects of the invention, there is provided a separator assembly for separating oil entrained as a mist in a pressurized flow of a refrigerant gas from the gas so that only essentially oil-free refrigerant flows through a refrigeration system refrigerant flow circuit, the assembly comprising an upright enclosure having lateral flow entry means located intermediate upper and lower ends of the enclosure. A tube length is carried in the enclosure and includes a part extending downwardly in the enclosure to a termination end thereof below the lateral flow entry means location, with the outer surface of the tube part and an inner surface of the enclosure defining an impact-separation zone therebetween. Means communicate the lateral flow entry means with a source of pressurized refrigerant gas having oil entrained as a mist therein whereby the gas flows into the enclosure and impacts against the tube outer surface and enclosure inner surface to cause oil mist to separate from the refrigerant gas and drop to the lower end of the enclosure, the upper end of the enclosure being sealed so that the post-impact separation zone gas flow is diverted downwardly in the enclosure to the tube termination end where it can access and enter an opening in said termination end and reverse flow upwardly in the tube and out an opening at a top end of the tube, there being means connecting the tube top end opening with a point of refrigerant use for conveying said gas to said use point. Means communicate a return flow of separated oil from the lower end of said enclosure to said refrigerant gas source, said oil return means comprising a conduit sized such that a mass flow of oil will freely pass into said conduit but a mass flow of gas into said conduit will be impeded.

According to a feature of the invention, there is further provided a separator unit for separating oil entrained as a mist in a pressurized flow of refrigerant gas which comprises an upright enclosure, means for admitting a laterally directed inflow of pressurized refrigerant gas having oil entrained as a mist therein into said enclosure, means defining an impact structure in said enclosure against which the gas flow impacts to cause oil to drop to a lower end of the enclosure, and means defining a plural segment torturous post-impact gas flow course in said enclosure, at least one of the flow course segments having a flow direction angulated with respect to the gas inflow direction, and another segment having a flow direction reciprocal to that of said one segment, the post-impact flow course terminating in outlet from the enclosure at an enclosure top end.

According to a still further feature of the invention, there is provided a method for separating oil mist entrained in a pressurized flow of refrigerant gas prior to delivery of the refrigerant to a point of refrigerant system cooling function in which oil mist-containing gas is flowed against an impact surface in an enclosed space to separate oil from the gas and cause it to drop to a bottom of the space, directing the gas in post-impact flow through a torturous flow path having outlet from the space at an upper end of the space, and returning the oil from the bottom of the space to a gas pressurization operation through a capillary tube that freely passes mass flow of oil but impedes mass flow of gas therethrough.

The above, and other objects, features and advantages of the present invention will become apparent from the following description read in conjunction with the accompanying drawing, in which like reference numerals designate the same elements.

DETAILED DESCRIPTION OF THE PREFERRED EMBODIMENTS

The present invention is concerned with separating oil entrained in a refrigerant gas flow from that flow so that only essentially oil-free refrigerant passes through the refrigerant flow circuit. Separation of oil immediately following pressurizing the refrigerant gas in a compressor eliminates chance of oil buildup at refrigerant flow circuit points where it could block the circuit, maintains system heat transfer enhanced since insulative effect of oil is eliminated therein, and it also facilitates early and continuous return flow of separated oil to the compressor to insure presence of adequate lubricant therein at all times.

Separation of oil from the refrigerant is particularly necessary in plural-stage refrigeration systems which effect cooling down to about minus 150 degrees C. and lower to avoid that the oil if present, would freeze in the refrigerating coils and stop up or create blockage in the system flow circuit and hence, the cooling it is supposed to effect. Further, blockage portends non-return of lubricant and/or refrigerant to the compressor and eventually burnout of the compressor if same be operated without lubrication or refrigerant.

While oil filtering means are known for removing oil from refrigerant for the reasons outlined above, most are not completely effective and/or are complex and expensive to make and maintain. Further, the most effective ones of such separator types are generally too large to use in small size refrigeration systems. For example, about the smallest size of the best types of cartridge type separators are about 15" by 3" envelope dimension. Such cartridge thus would not be suited for use in a household size refrigerator. The oil separator assembly and method of separation described in detail below provide on the other hand, highly effective, compact sized, yet simple and inexpensive accomplishment of the protection of refrigeration systems of wide range of sizes both as to cooling functioning and compressor lubricant protection.

Figure 1:
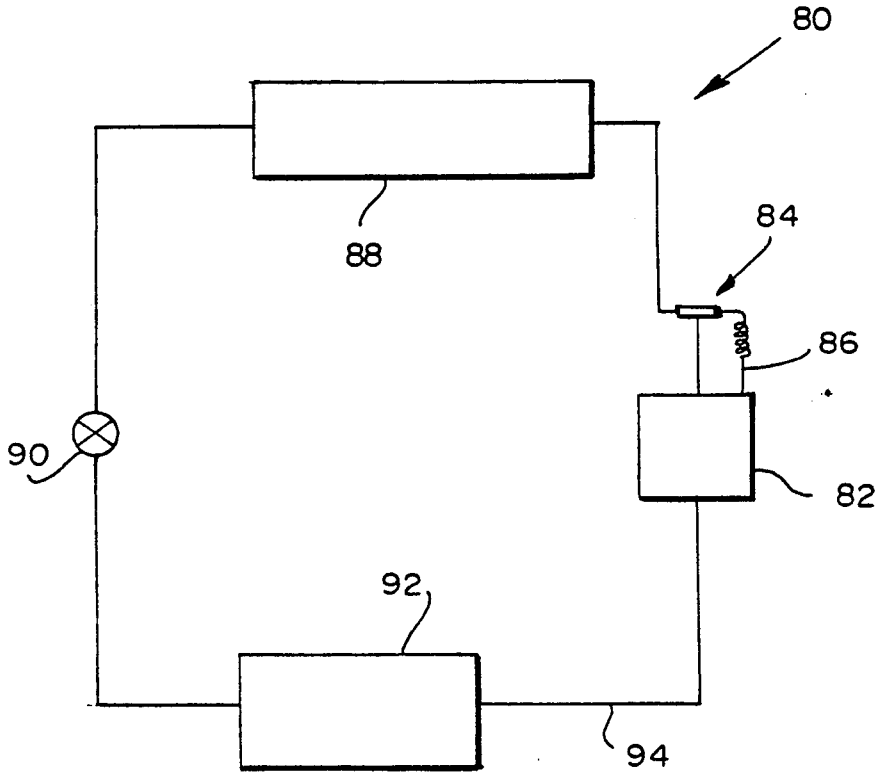
FIG. 1 is a schematic showing of a typical, small size, single-stage vapor-compression refrigeration system with which the oil separation assembly and separation method of the invention can be used.

Referring to FIG. 1, refrigeration system 80 includes a motor-driven compressor 82 which receives spent or heat-laden refrigerant (in gas form from the evaporator) and pressurizes it. The refrigerant used in the system can be any one of a number of such suited for the intended purpose including fluorinated hydrocarbons sold under the trademark FREON, ammonia, and others. The pressurized refrigerant gas on leaving the compressor will contain compressor lubricant (oil) as a mist therein. The oil will be separated from the refrigerant in the separator assembly 84 and returned via capillary line 86 to the compressor. Separator assembly 84 is constructed in and operates in like manner to the oil separator assembly 30 (FIG. 2) to be described in detail later on. The essentially oil-free refrigerant gas on leaving the separator assembly 84 passes through condenser 88 wherein in customary fashion, heat is removed from the pressurized refrigerant gas and it is condensed to liquid refrigerant form, the liquid refrigerant then passing through expansion valve 90 from whence it passes into evaporator 92 to perform the refrigerant function of taking up heat from a space or substance associated with the evaporator thereby to cool same, the refrigerant being changed to gas form incident its absorbing heat in the evaporator. This heat-containing refrigerant is returned to the compressor via conduit 94.

Figure 2:
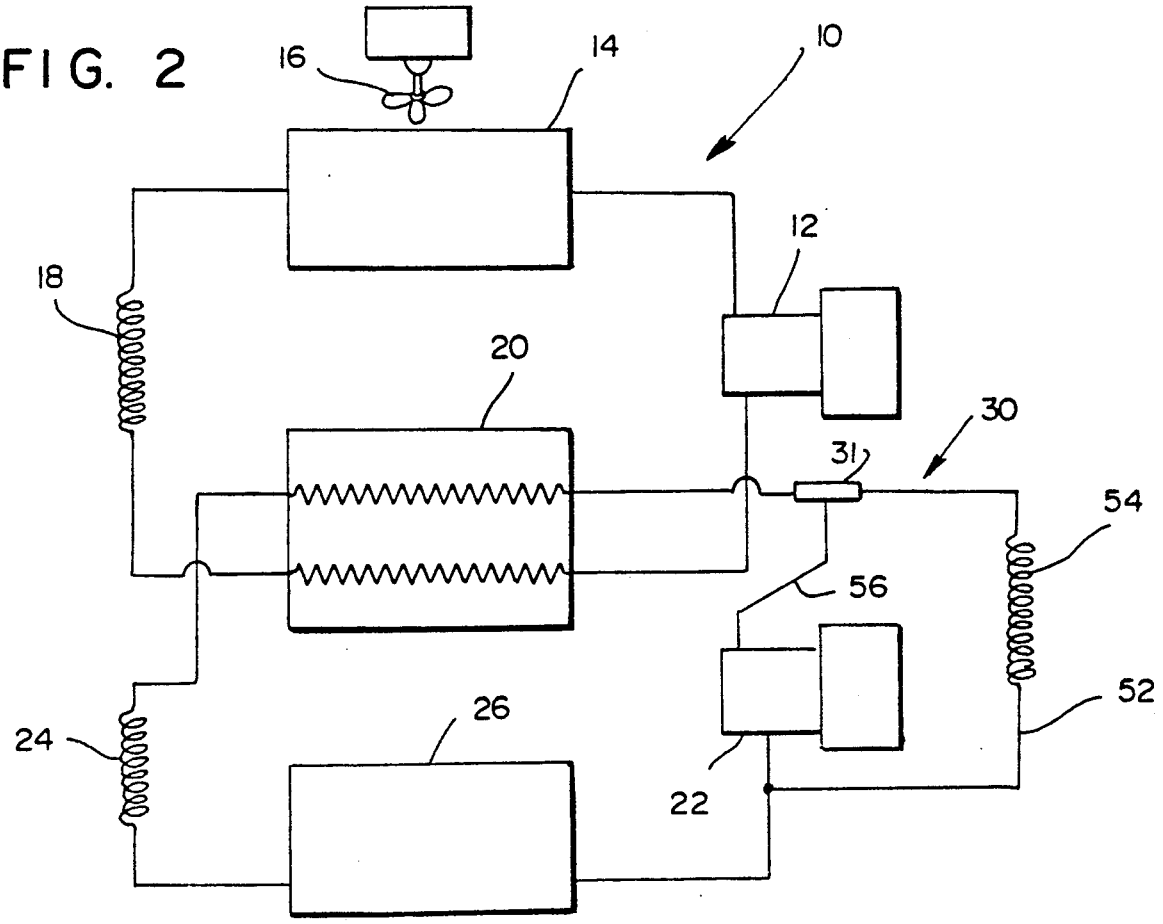
FIG. 2 is a schematic depiction of a two-stage cascade refrigeration system provided with an oil separator assembly in accordance with the principles of the invention.

Referring now to FIG. 2, there is depicted a two-stage cascade type refrigeration system 10 which can be used by way of example, for cooling laboratory specimens in connection with specimen preservation studies and wherein the specimens are to be cooled to a very low temperature and wherein system temperature at certain flow circuit locations can be as low as about minus 104–110 degrees C. The first or high level refrigeration stage includes a gas compressor unit 12 which discharges compressed gaseous refrigerant to a condenser 14 wherein the refrigerant gas is condensed to liquid form by the cooling effect of fan unit 16, the fan supplying cooling air in heat exchange pass over of coils or condenser tubes through which the gas is passing. From the condenser 14, the liquid form refrigerant is conveyed to an expansion operation, e.g., passage through an expansion valve, but in the depicted embodiment, a capillary tube expansion unit 18 being used for this purpose, the refrigerant thereafter passing to cascade condenser-evaporator unit 20 for purpose as will be explained shortly. After passing through the condenser-evaporator unit 20, refrigerant return is to the inlet side of the compressor unit 12 for new cycle refrigerant utilization.

The low level stage of system 10 includes a compressor unit 22 which discharges compressed refrigerant gas to condenser-evaporator unit 20 wherein the refrigerant from the high stage passes in heat exchange relationship with the gas flow from compressor unit 22 and takes up heat from the low stage refrigerant which is condensed to liquid form. This cold and high pressure liquid low level refrigerant then passes through another capillary expansion unit 24 from whence it passes into evaporator 26 to cool that space, such space being that in which the specimens are present, the refrigerant being evaporated by heat it absorbs in the evaporator.

On outlet from evaporator 26, the now gaseous low pressure refrigerant passes back to the inlet side of compressor unit 22 for start of a new cycle. In the condenser-evaporator unit 20 and ensuing flow circuit to the evaporator unit 26, the low level refrigerant will encounter temperatures of an order below that temperature at which oil if present in the refrigerant would freeze. This can not happen because the oil has been removed with the oil separator assembly shown generally at 30 in FIG. 2.

Figure 3:
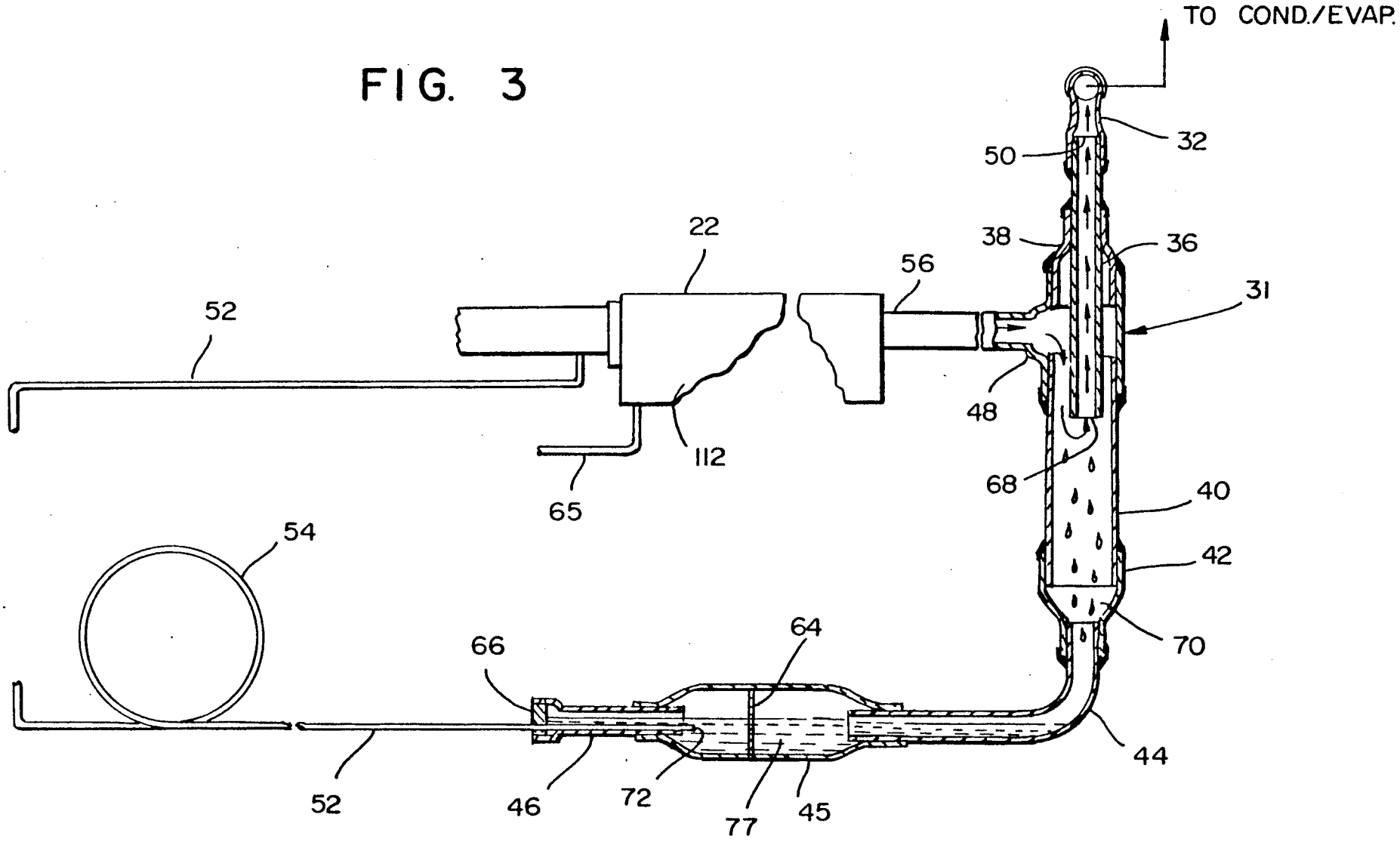
FIG. 3 is a vertical sectional view of the oil separator of the invention showing in detail the several components of which it is constituted.

Assembly 30 functions to remove essentially all of the entrained oil carried out of the compressor unit 22 in the pressurized gas discharge prior to flow of the refrigerant to system flow circuit locations where the oil could freeze. In connection with the separation operation, it occurs in a manner that involves utilization of impacting force, flow velocity reduction, and mass weight principle to remove oil from the refrigerant. Further specific description of assembly 30 will be given next with reference being made additionally to FIG. 3.

Separator assembly 30 includes a separator unit 31 having placement in the refrigeration system such that generally, it will be disposed in an upright orientation. The separator unit 31 comprises an enclosure shown in one embodiment form thereof as being fabricated from various copper tubing elements inclusive of an elbow 32, a tube length 36, a reducing bushing 38, another larger tube 40, and a reducing coupling 42. From the enclosure lower end there extends another elbow 44, a strainer housing 45, and a length of refrigeration tubing 46, all these elements being joined in the FIG. 3 assemblage configuration by brazed joinder of the mentioned elements to form an overall gas-tight structure.

Part of the enclosure structure is provided by the tee-branch member 48 serving, inter alia, as inlet means by which a pressurized inflow of oil-containing refrigerant gas can enter the enclosure on discharge of same from the outlet of compressor unit 22. Tube length 36 extends downwardly from the enclosure top for some distance below the inlet provided by tee-branch 48, the tube having a lower end termination as at 68. The outer surface of the tube length and the inner surface of the tee-branch define an annular space within the enclosure which constitutes an impact-separation zone. The top of the enclosure it is noted is sealed as by the joinder of bushing 38 with the tube part 36, but the top opening 50 of the tube communicates with elbow 32 for outflow of refrigerant gas to a use point as will be indicated below.

The lower end of the enclosure as at 70 represents the initial point of the return path of separated oil travel back to compressor unit 22. The oil return flow is by way of elbow 44, strainer housing 45, into opening 72 at an entrance end of capillary tube conduit 52, through the capillary tube 52 and then into the gas return line immediately before the entry tthereof to compressor 12. The oil also could be returned directly to the compressor crankcase as by a terminal capillary tube section 65 being connected to the crankcase section 112. Capillary tube 52 includes a number of tube windings as at 54 to provide a particular capillary tube overall length within a foreshortened lineal expanse. Refrigeration tubing length 46 is plugged as at 66, and a screen filter 64 is disposed crosswise to the oil flow direction for catching and retaining therein any solids as may be present in the oil, e.g., a particle of brazing material loosened from a brazed joint.

Description now will be given of the functioning of the assembly 30 in separating oil from gas and returning the oil to the compressor unit. Pressurized refrigerant gas outflows from compressor unit 22 through line 56 which line is connected to tee-branch 48 so that an inflow of oil-mist containing refrigerant gas makes lateral inflow entry into the enclosure and impacts against the tube length 36 outer surface and the inner surface of the tee-branch encircling the tube length. This impacting action causes a certain and first separation of oil from the gas stream, which separated oil drops to the bottom 70 of the enclosure.

Entry of the oil-containing gas flow to the impact-separation zone is to a space or volume much larger comparative to that of line 56 feeding gas flow to the separator. As a result, the gas flow undergoes a velocity drop and reduced capacity to hold an oil mass therein so a second separation of oil from the refrigerant takes place. Post-impact flow path of the gas is through a torturous flow path defined by a first flow path segment extending downwardly from the entry point and orthogonally relative to the entry flow direction, this flow continuing down at least to the end termination location of the tube 36 at which point, the gas can access opening 68 and enter the tube for upward, second flow path segment reciprocal direction travel upwardly and to the elbow 32 from whence it flows to condenser-evaporator unit 20 and through the flow circuit and for the purpose given earlier herein. Accompanying this gas flow direction change occurs a third separation of oil from the gas.

The separated oil dropping from the locations at which separation occurred, passes to the bottom of enclosure 31 and flows out of the enclosure and into the strainer housing 45 wherein it will build up a stock or pool of oil 77 from which oil will flow into the capillary tube 52, the oil entering capillary tube entry opening 72. Oil only will flow through the small diameter capillary tube 52 as this capillary is sized to freely pass a mass flow of oil therethrough, while at the same time the tube is given such size and length as will impede or prevent any measurable mass flow of refrigerant gas therethrough. The pressure differential existing between the strainer housing and the inlet side of compressor 22 insures that the oil will flow back to the compressor.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A separator assembly for separating oil entrained as a mist in a pressurized flow of a refrigerant gas from the gas so that only an essentially oil-free refrigerant flows through a refrigerant system refrigerant flow circuit, said assembly comprising an upright enclosure having lateral flow entry means located intermediate upper and lower ends of said enclosure, a tube length carried in said enclosure, said tube length including a part extending downwardly in the enclosure to a termination end thereof below said lateral flow entry means location, an outer surface of the tube and an inner surface of the enclosure defining an impact-separation zone therebetween, means communicating the lateral flow entry means with a source of pressurized refrigerant gas having oil entrained as a mist therein whereby the gas flows into said enclosure and impacts against the tube outer surface and the enclosure inner surface to cause oil to separate from the refrigerant gas and drop to the lower end of the enclosure, the upper end of said enclosure being sealed so that post impact-separation zone gas flow is diverted downwardly in the enclosure to the tube termination end where it can access and enter an opening in said end termination and reverse flow upwardly in the tube and out an opening at a top end of the tube, means connecting the tube top end opening with a point of refrigerant use for conveying said gas to said use point, and means for communicating a return flow of separated oil from the lower end of said enclosure to said refrigerant gas source, said oil return means comprising a conduit sized such that a mass flow of oil will freely pass into said conduit but a mass flow of gas into said conduit will be impeded.

2. The separator assembly of claim 1 in which the oil return conduit includes a capillary tube.

3. The separator assembly of claim 2 in which said oil return conduit includes a strainer section disposed upstream of the capillary tube.

4. The separator assembly of claim 3 in which said strainer section includes a strainer element for retention thereby of any solids particles contained in the return oil flow.

5. The separator assembly of claim 2 in which the capillary tube has an inlet end, said inlet end being received in a downstream end of said strainer section.

6. The separator assembly of claim 2 in which the capillary tube includes a coil of plural tube windings for providing increased effective capillary tube length in a foreshortened return conduit course length.

7. The separator assembly of claim 1 in which the enclosure is a tubular member, the tube length carried therein having a another part extending above a top end of said enclosure.

8. The separator assembly of claim 7 in which the enclosure and tube length are cylindrically configured, the impact-separation zone defined therebetween being a space of annular section.

9. The separator assembly of claim 1 in which the refrigerant gas source comprises a gas compressor having a gas return line through which used refrigerant as a gas enters the compressor following conveyance thereto from the use point, the oil return conduit being connected to said gas return line proximal the compressor.

10. The separator assembly of claim 1 in which the refrigerant gas source comprises a gas compressor having a crankcase section, the oil return conduit being connected to said crankcase section.

11. The separator assembly of claim 1 in which the impact-separation zone of said enclosure constitutes a substantially enlarged space comparative with that of said lateral flow entry means whereby upon entry of gas flow thereto gas velocity reduces and a further separation of oil therefrom occurs, the gas flow in accessing said lower end and reverse flowing upwardly producing an additional separation of oil from the gas.

12. In a separator assembly for separating oil entrained as a mist in a pressurized flow of a refrigerant gas from the gas so that only an essentially oil-free refrigerant flows through a refrigeration system refrigerant flow circuit, a separator unit comprising an upright enclosure, means for admitting a laterally directed inflow of pressurized refrigerant gas having oil entrained as a mist therein into said enclosure, means defining an impact structure in said enclosure against which the gas flow impacts to cause oil to separate from the refrigerant gas and drop to a lower end of the enclosure, and means defining a plural segment torturous post-impact gas flow course in said enclosure, at least one of the flow course segments having a flow direction angulated with respect to the gas inflow direction, and another segment having a flow direction reciprocal to that of said one segment, the post-impact gas flow course terminating in outlet from the enclosure at an enclosure top end.

13. The separator unit of claim 12 in which said one flow course segment has a flow direction orthogonal to the gas inflow direction.

* * * * *